US006534229B2

(12) United States Patent
Ohba et al.

(10) Patent No.: US 6,534,229 B2
(45) Date of Patent: Mar. 18, 2003

(54) DEVELOPER FOR ELECTROSTATIC IMAGE DEVELOPMENT

(75) Inventors: Katsunori Ohba, Oyama (JP); Katsuyuki Ogura, Omiya (JP); Masanobu Nakamura, Warabi (JP); Toshiro Kogawara, Iwatsuki (JP); Hideki Gambayashi, Ageo (JP)

(73) Assignee: Dainippon Ink and Chemicals, Inc., Tokyo (JP)

( * ) Notice: Subject to any disclaimer, the term of this patent is extended or adjusted under 35 U.S.C. 154(b) by 0 days.

(21) Appl. No.: 09/780,337

(22) Filed: Feb. 12, 2001

(65) Prior Publication Data

US 2001/0019805 A1 Sep. 6, 2001

(30) Foreign Application Priority Data

Feb. 14, 2000 (JP) ..... 2000-034872

(51) Int. Cl.[7] ..... G03G 9/087; G03G 9/097

(52) U.S. Cl. ..... 430/108.2; 430/109.4; 430/110.4; 430/111.41

(58) Field of Search ..... 430/111.41, 110.4, 430/109.4, 108.2

(56) References Cited

U.S. PATENT DOCUMENTS

| | | | | |
|---|---|---|---|---|
| 5,328,792 A | * | 7/1994 | Shigemori et al. | 430/110.4 |
| 5,504,272 A | | 4/1996 | Uchiyama et al. | 118/653 |
| 5,866,289 A | * | 2/1999 | Asanae et al. | 430/111.41 |

FOREIGN PATENT DOCUMENTS

| | | | |
|---|---|---|---|
| EP | 0 334 099 | | 9/1989 |
| EP | 0495476 A1 | * | 7/1992 |
| EP | 0 606 100 | | 7/1994 |

OTHER PUBLICATIONS

Diamond, Arthur S. (editor) Handbook of Imaging Materials. New York: Marcel–Dekker, Inc. (1991) pp. 178–181, 201–203.*

Patent Abstracts of Japan, vol. 014, No. 279, (P–1062), Jun. 15, 1990 & JP 02–082267.

Japanese Unexamined Patent Application, First Publication (Kokai), No. Hei–4–362956 (Kao Corp), published on Dec. 15, 1992 * English Abstract *.

Japanese Unexamined Patent Application, First Publication (Kokai), No. Hei–4–97366 (Mitsubishi Kasei Corp), Published on Mar. 30, 1992; granted as Japanese Patent No. 3006054 * English Abstract *.

Japanese Unexamined Patent Application, First Publication (Kokai), No. Hei–3–7948 (Mitsubishi Kasei Corp), published on Jan, 16, 1991 * English Abstract *.

Japanese Unexamined Patent Application, First Publication (Kokai), No. Hei–5–119509 (Ricoh Co Ltd), published on May 18, 1993.

* cited by examiner

*Primary Examiner*—Christopher Rodee
(74) *Attorney, Agent, or Firm*—Armstrong, Westerman & Hattori, LLP

(57) ABSTRACT

An object of the present invention is to provide a developer for electrostatic image development, which exhibits stable charge behavior during printing even when using a polyester resin and does not cause contamination of the inside of the apparatus because of less scattering of the toner, and also facilitates easy maintenance. The developer for electrostatic image development of the present invention comprises colored resin particles comprising at least a binder resin and a colorant, and a magnetic carrier, wherein a proportion of said colored resin particles having a particle diameter in a range of from 12 μm to 16 μm, inclusive, in said developer and a specific charge amount of said colored resin particles meet the following expression (1):

$$5.18+0.12\times A<B \quad (1)$$

(where A represents a proportion (% by volume) of colored resin particles having a particle diameter in a range of from 12 μm to 16 μm, inclusive, and B represents a specific charge amount Q/M (μC/g) of colored resin particles having a particle diameter in a range of from 12 μm to 16 μm, inclusive).

13 Claims, No Drawings

DEVELOPER FOR ELECTROSTATIC IMAGE DEVELOPMENT

BACKGROUND OF THE INVENTION

1. Field of the Invention

The present invention relates to a developer for electrostatic image development which is employed in electrophotographic methods, electrostatic recording methods, and electrostatic printing methods.

2. Description of Related Art

Various electrophotographic methods have been disclosed in, for example, U.S. Pat. No. 2,297,691, Japanese Examined Patent Application, Second Publication No. Sho 42-23910, and Japanese Examined Patent Application, Second Publication No. Sho 43-24748; commonly, an electrostatic latent image is formed on an electrostatic latent image bearing medium such as a photoconductive photosensitive medium or the like by means of charge or light exposure, and then this electrostatic latent image is developed employing a toner composition containing a colorant in a binder resin, and the resulting toner image is transferred to a support medium such as transfer paper or the like and fixed, and a visible image is thus formed.

Various development methods have been known and incorporated as part of the electrophotographic method, and are roughly classified into a two-component development method employing microparticles (20–500 $\mu$m) such as iron powder, ferrite powder, nickel powder, glass powder and the like, and a single-component development method employing a developer made of a toner only.

Typical examples of the two-component development method include a cascade method described in U.S. Pat. No. 2,618,552 and a magnetic brush development method described in U.S. Pat. No. 2,874,063. In these methods, a carrier takes partial charge of functions such as stirring, transfer and charging of the developer and, therefore, the function of the carrier and that of the toner are clearly separated. Accordingly, the two-component development method has been widely employed at present because it can control charging of the toner and form the developer layer comparatively easily and also facilitates more rapid processing.

In concert with the recent evolution of an information-oriented society, needs such as an improvement in the quality of the printed image as well as more rapid processing, an increase in density and the long-term storage stability of recording have been realized in the fields of electrophotography, electrostatic recording and electrostatic printing. Thus, great hopes are entertained of an improvement in the properties of a toner capable of recording an electrostatic latent image on a non-printed medium.

Apparatuses employing such an electrostatic image development method include copying machines, printers and the like. The processing speed varies depending on the manufacturer and type, but many apparatuses have the processing speed corresponding to 30 sheets per minute in the case of an office printer or about 60–100 sheets per minute for an office copying machine, when converted to printing speed using A-4 size paper. As a result of increases in speed for developing apparatus, conventional developing apparatus has recently been superseded by a high-speed apparatus which has a processing speed corresponding to 100 sheets per minute when converted to printing speed using A-4 size paper in a longitudinal direction and 140 sheets per minute when converted to printing speed using A-4 size paper in a lateral direction, and which has a fixing speed of 30 m per minute.

A toner for a two-component developer, which is suited for use in high-speed printing, should ideally meet certain important requirements such as stable charge behavior during mass-circulation printing with a resulting stable image with less fogging as well as solving the problem of scattered toner so as to not contaminate the inside of the machine during long-term use. These objects are largely dependent on the charging properties of the toner.

With respect to contamination of the inside of the apparatus, scattering of the toner is a serious problem in apparatus for high-speed printing. That is, scattering of the toner is a significant problem because it causes not only contamination of the printed image but also contamination of the inside of the apparatus, thereby impairing maintainability and further causing various apparatus problems.

Although a polyester resin has recently been employed with view to bringing about high durability, polyester resin was not found to be particularly suited for the preparation of a positive-charge toner used for high-speed printing because it exhibits strong negative-charge properties as compared with conventionally used styrene-acrylic resin. Therefore, a toner has never been obtained which possesses all the qualities required of a toner for high-speed printing, such inhibiting the scattering of the toner.

BRIEF SUMMARY OF THE INVENTION

An object of the present invention is to provide a developer for electrostatic image development, which exhibits stable charge behavior during printing even when using a polyester resin and does not cause contamination of the inside of the apparatus because of less scattering of the toner, and also facilitates easy maintenance.

Another object of the present invention is to provide a developer for electrostatic image development, which can attain the objects described above during printing at high speeds exceeding 20 or 30 m per minute.

As a result of diligent research with the object of solving the problems described above, the present inventors have found that the proportion (% by volume) of a toner having a comparatively large particle diameter in a range of from 12 $\mu$m to 16 $\mu$m, inclusive, and its specific charge amount exert a large influence on the amount of the toner scattered, thus obtaining the present invention.

That is, the present invention provides a developer for electrostatic image development comprising colored resin particles comprising at least a binder resin and a colorant, and a magnetic carrier, wherein a proportion of said colored resin particles having a particle diameter in a range of from 12 $\mu$m to 16 $\mu$m, inclusive, in said developer and a specific charge amount of said colored resin particles meet the following expression (1):

$$5.18+0.12\times A<B \quad (1)$$

(where A represents a proportion (% by volume) of colored resin particles having a particle diameter in a range of from 12 $\mu$m to 16 $\mu$m, inclusive, and B represents a specific charge amount Q/M ($\mu$C/g) of colored resin particles having a particle diameter in a range of from 12 $\mu$m to 16 $\mu$m, inclusive).

According to the present invention, in the developer for electrostatic image development comprising colored resin particles comprising at least a binder resin and a colorant, and a magnetic carrier, said colored resin particles meet the expression (1) and, therefore, contamination of the inside of the apparatus hardly occurs during long-term use because of less scattering of the toner, thus making it possible to obtain an image with less contamination (fogging) of the printed image due to scattering of the toner.

Particularly, the developer for electrostatic image development containing the colored microparticles (toner) which meet the expression (1) can be effectively employed as a developer for developing apparatus for printing at high speeds exceeding 20 or 30 m per minute.

DETAILED DESCRIPTION OF THE INVENTION

In general, the toner is made of colored resin particles comprising a binder resin, a colorant, a releasing agent and a charge control agent, and scattering of the toner is a phenomenon where, when the specific charge amount of the toner is reduced, a Coulomb force between the toner and carrier cannot overcome a centrifugal force due to rotation of a magnetic brush, causing the toner to scatter from the carrier. However, since the processing speed during the developing and the charge amount of the toner are inextricably linked in this phenomenon, only a quantitative argument has hitherto been made.

The target particle diameter of the toner to be provided as the product is about 10 $\mu$m, and the toner is generally obtained in the form of a powder having a fixed particle size distribution, though it varies depending on the pulverizing and classifying methods.

As a result of diligent research into the powder, the powder being an aggregate of various particles having different particle diameters, the present inventors have found that the amount of the toner scattered can be very effectively limited by controlling the proportion (% by volume) of the toner having a particle diameter in a range of from 12 $\mu$m to 16 $\mu$m, inclusive, and provided that its specific charge amount have the relationship of the above expression (1). The left side of the expression (1) shows the degree of scattering of the particles having a particle diameter in a range of from 12 $\mu$m to 16 $\mu$m, inclusive, due to a centrifugal force, while the right side shows the degree of scattering inhibition of the particles due to a Coulomb force.

Particularly, the developer for electrostatic image development containing the colored microparticles (toner) which meet the expression (1) can be effectively used as a developer for developing apparatus for printing at high speeds exceeding 20 or 30 m per minute.

Commonly, the particle size distribution of the powder can be simply measured by a multisizer (particle size distribution measuring device, produced by Coulter Co.), while the charge amount distribution according to the particle diameter of the toner can be simply measured by E-SPART ANALYZER (produced by Hosokawa Micron Co.). According to the present invention, it has been made possible to inhibit the amount of the toner scattered by directly employing the value obtained by such a simple measurement.

The E-SPART ANALYZER is used for calculating the particle diameter of individual particles and charge amount by dropping toner particles between two acoustically oscillating electrodes having opposite polarities, thereby to oscillate toner particles, moving the toner particles to the electrodes due to an electric field action of the electrodes, and simultaneously measuring the frequency of the toner and movement. According to this device, the charge amount distribution of the group of particles having a particle size within a specific range can be measured and, at the same time, the total charge amount of the group of particles can be easily measured. The details of the measurement principle to estimate the charge amount of the toner by the E-SPART ANALYZER are described in pages 101–104 of "The papers of Japan Hardcopy' 90" by Hosokawa Micron Co.

The developer for electrostatic image development according to the present invention can be obtained by mixing the toner with the magnetic carrier and charging the mixture so as to meet the above expression (1).

In the present invention, colored resin particles comprising at least a binder resin and a colorant are employed. The binder resin employed in the present invention is not specifically limited provided it meets the expression (1) when converted into the toner. Specific examples thereof include polyester resin, polystyrene resin, styrene-acrylic resin, styrene-butadiene resin, epoxy resin, butyral resin, xylene resin, coumarone resin, and the like. Among these binder resins, styrene-acrylic resin and polyester resin are preferred, and polyester resin can be employed particularly preferably because of its good balance between fixing properties and durability.

The molecular structure and composition of the polyester resin, which can be employed in the present invention, are not specifically limited. For example, there can be employed resins obtained by dehydration condensation of dicarboxylic acid and diol described below employing a conventional method.

(1) Dicarboxylic acids

Dicarboxylic acids include, for example, phthalic anhydride, terephthalic acid, isophthalic acid, orthophthalic acid, adipic acid, maleic acid, maleic anhydride, fumaric acid, itaconic acid, citraconic acid, hexahydrophthalic anhydride, tetrahydrophthalic anhydride, cyclohexane dicarboxylic acid, succinic acid, malonic acid, glutaric acid, azelaic acid, sebacic acid, and the like, as well as derivatives or ester products thereof.

(2) Diols

Diols include, for example, ethylene glycol, diethylene glycol, triethylene glycol, propylene glycol, dipropylene glycol, tripropylene glycol, butane diol, pentane diol, hexane diol, cyclohexane dimethanol, bisphenol A, polyoxyethylene-(2.0)-2,2-bis(4-hydroxyphenyl) propane and derivatives thereof, polyoxypropylene-(2.0)-2,2-bis(4-hydroxyphenyl) propane, polyoxypropylene-(2.2)-polyoxyethylene-(2.0)-2,2-bis(4-hydroxyphenyl) propane, polyoxypropylene-(6)-2,2-bis(4-hydroxyphenyl) propane, polyoxypropylene-(2.2)-2,2-bis(4-hydroxyphenyl) propane, polyoxypropylene-(2.4)-2,2-bis(4-hydroxyphenyl) propane, polyoxypropylene-(3.3)-2,2-bis(4-hydroxyphenyl) propane and derivatives thereof, polyethylene glycol, polypropylene glycol, ethylene oxide-propylene oxide random copolymer diol, ethylene oxide-propylene oxide block copolymer diol, ethylene oxide-tetrahydrofuran copolymer diol, polycaprolactone diol, and the like.

(3) Polyvalent monomers having three or more valances

If necessary, there can be employed polyvalent carboxylic acids having three or more functional groups such as trimellitic acid, trimellitic anhydride, pyromellitic acid, pyromellitic anhydride, and the like, as well as derivatives or ester products thereof; polyvalent alcohols having three or more functional groups such as sorbitol, 1,2,3,6-hexane tetraol, 1,4-sorbitan, pentaerythritol, 1,2,4-butane triol, 1,2,5-pentane triol, glycerin, 2-methyl propane triol, 2-methyl-1, 2,4-butane triol, trimethylol ethane, trimethylol propane, 1,3,5-trimethylol benzene, and the like; epoxy compounds having five or more valences such as cresol novolak type epoxy resin, phenol novolak type epoxy resin, polymers or copolymers of vinyl compounds having an epoxy group, epoxylated resorcinol-acetone condensate, partially epoxylated polybutadiene, and the like; epoxy compounds having two to four valances such as bisphenol A epoxy resin, bisphenol F epoxy resin, bisphenol S epoxy resin, glycerin triflycidyl ether, trimethylolpropane triglycidyl ether, trimethylolethane triglycidyl ether, pentaerythritol tetraglycidyl ether, and the like, together with the dicarboxylic acids and diols described above.

The polyester resin in the present invention may be obtained by conducting a dehydration condensation reaction or an ester exchange reaction employing the raw material components described above in the presence of a catalyst. The reaction temperature and reaction period are not particularly restricted; however, these are normally within a range of 150–300° C. and 2–24 hours.

Examples of the catalyst which may be employed when conducting the reaction described above include, for example, zinc oxide, tin (I) oxide, tetrabutyl titanate, monobutyltin oxide, dibutyltin oxide, dibutyltin dilaurate, paratoluene sulfonic acid, and the like.

The polyester resin is preferably a polyester resin which has a glass transition temperature within a range of 55–85° C. and a softening point within a range of 90–180° C.

The softening point is particularly preferably within a range of 100–170° C. The softening point in the present invention is a softening point measured by the method defined in ASTM E28-517.

The acid number is preferably 20 mgKOH/g or less, and particularly preferably 10 mgKOH/g or less, so as not to cause a reduction of the charge amount as a result of enhancing the moisture absorption properties and to impart storage stability and developing properties.

It is preferred to employ a resin of a straight-chain polyester resin (i) in combination with a crosslinked polyester resin (ii) as described below so as to secure wider fixing/offset regions. Where such a combination is employed, it is not necessary for individual resins to have the glass transition temperature and softening point described above, provided that after mixing the combined resin has the glass transition temperature and softening point described above.

With respect to the crosslinked polyester resin (ii), THF-insoluble matter may be present in the structure. As used herein, the term "THF-insoluble matter" refers to a residue on a particular filter paper (No. 86R, produced by Toyo Filter Paper Corp.), which is obtained by placing 1 g of the synthesized resin powder on the filter paper and heating at reflux in THF as a solvent for eight hours employing a Soxhlet's reflux condenser. As used herein, the term "crosslinked structure" includes both a branched structure wherein a polyester backbone chain is branched and a structure wherein a polyester backbone chain is bonded in the form of a network. In the polyester having the branched structure, the content of the THF-insoluble matter defined in the present invention is usually 0% and the content of the THF-insoluble matter increases with an increase in the network.

The straight-chain polyester resin (i) employed preferably in the present invention is a polyester resin which does not contain THF-insoluble matter and has a softening point within a range of 80–120° C. and a glass transition point of 55–85° C., and such a polyester resin can be obtained, for example, by dehydration condensation of dicarboxylic acid and diol employing a conventional method.

The polyester resin employed in the present invention may have glass transition point and melt viscosity properties suited for use in the toner for two-component development.

With respect to the straight-chain polyester resin (i), the softening point is preferably within a range of 80–120° C., and more preferably within a range of 90–110° C. With respect to the molecular weight, the weight-average molecular weight (Mw) is preferably within a range of 7000–12000 and the ratio of the weight-average molecular weight to the number-average molecular weight (Mn), Mw/Mn, is preferably 4 or less, and particularly preferably 3 or less.

When the softening point is 80° C. or lower or Mw is 7000 or less, the toner is liable to cause an aggregation phenomenon, resulting in problems during storage and printing. On the other hand, when the softening point exceeds 120° C. or Mw exceeds 12000, the fixation properties become inferior.

The crosslinked polyester resin (ii), which can be employed in the present invention, can be obtained by dehydration condensation of the above-described dicarboxylic acid (1) and diol (2) described above and a polyvalent monomer (3) having three or more valances.

With respect to the crosslinked polyester resin (ii), the softening point is preferably within a range of 130–180° C., and more preferably within a range of 140–170° C. The content of the THF-insoluble matter preferably exceeds 0% but is 20% or less and Mw of the THF-soluble matter is preferably within a range of 100000–400000 and, moreover, Mw/Mn is preferably 10 or more, particularly preferably 15 or more.

When the softening point is 130° C. or lower or Mw is 100000 or less, the toner is liable to cause an offset phenomenon during the fixation. On the other hand, when the softening point exceeds 180° C. or the content of the THF-insoluble matter is 20% or more or Mw exceeds 400000, the fixation properties become inferior.

A mixing ratio of the straight-chain polyester (i) to the crosslinked polyester resin (ii), (i)/(ii), is preferably within a range of 2/8–8/2, and more preferably within a range of 3/7–7/3. When the mixing ratio of the straight-chain polyester (i) is within the above range, the resulting product can be provided with excellent fixing properties and anti-offset properties.

On the other hand, both of the straight-chain polyesters and cross-linked polyesters preferably have a glass transition temperature (Tg) of 45° C. or higher, and particularly preferably within a range of 50–85° C.

The acid number is preferably within a range of 1–20 mgKOH/g, and particularly preferably within a range of 3–10 mgKOH/g. When the acid number is too high, the moisture absorption properties are enhanced causing a reduction of the charge and this is not preferred in view of the storage stability and developing properties.

Conventional colorants may be employed in the present invention provided they meet the above expression (1). Examples of black colorants include carbon blacks which are differentiated based on their method of preparation, such as furnace black, channel black, acetylene black, thermal black, lamp black, and the like, which are classified by the manufacturing process; examples of blue colorants include the phthalocyanine C.I. Pigment Blue 15-3, and the indanthrone C.I. Pigment Blue 60 and the like; examples of red colorants include the quinacridone C.I. Pigment Red 122, the azo C.I. Pigment Red 22, C.I. Pigment Red 48:1, C.I. Pigment Red 48:3, C.I. Pigment Red 57:1, and the like; yellow colorants include the azo C.I. Pigment Yellow 12, C.I. Pigment Yellow 13, C.I. Pigment Yellow 14, C.I. Pigment Yellow 17, C.I. Pigment Yellow 97, C.I. Pigment Yellow 155, the isoindolinone C.I. Pigment Yellow 110, the benzimidazolone C.I. Pigment Yellow 151, C.I. Pigment Yellow 154, C.I. Pigment Yellow 180, and the like. The amount of the colorant contained is within a range of 1–20 parts by weight. One type of such colorant may be employed, or two or more may be employed in combination.

In the present invention, releasing agents can be employed.

Any of the conventionally known releasing agents can be employed as the releasing agent employed in the toner of the present invention, and examples thereof include synthetic waxes, for example, polyolefin wax such as polyethylene wax, polypropylene wax, or the like; and natural waxes, for example, carnauba wax, montan wax and/or rice wax.

These waxes may be employed alone or in combination and good fixation offset properties can be obtained with a content within a range of 0.3–15 parts by weight, and preferably within a range of 1–5 parts by weight, based on the binder resin. When the amount is smaller than 0.3 parts by weight, the anti-offset properties are impaired. On the other hand, when the amount is larger than 15 parts by weight, the fluidity of the toner becomes inferior and, furthermore, spent carrier remains as a result of deposition on the surface of the carrier, thereby exerting an adverse influence on charge characteristics of the toner.

In the present invention, charge control agents, particularly positive charge control agents can be employed.

The positive charge control agents employed in the present invention are not specifically limited as far as they meet the above expression (1), and conventionally known positive charge control agents can be employed. For example, resins containing nigrosine dyes, quaternary ammonium salts, and resins containing quaternary ammonium salts and/or resins containing amino groups may be employed alone or in combination. The positive charge control agents include, but are not limited to, the following.

The content of the charge control agent is preferably within a range of 0.3–10 parts by weight, and more preferably within a range of 1–5 parts by weight, based on 100 parts by weight of the binder resin.

The quaternary ammonium salt compound is at least one selected from the compounds (I) to (II) particularly preferably having the following structures. The compound (I) includes BONTORON P-51 (produced by Orient Chemical), while the compound (II) includes TP-302, TP-610 and TP-415 (produced by Hodogaya Chemical Industries Co., Ltd.).

It is also preferred to use the following compound (III).

General formula (I)

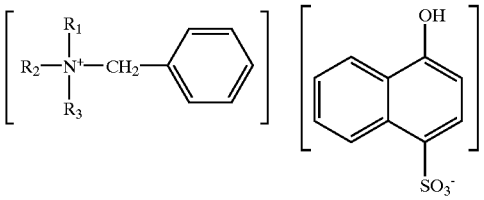

(In the formula, $R_1$–$R_3$ represents a group of $C_nH_{2n+1}$, provided that n represents an integer within a range of 1–10 and $R_1$–$R_3$ may be the same or different)

General Formula (II)

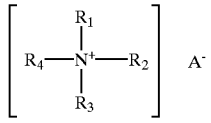

(In the formula, $R_1$, $R_2$, $R_3$ and $R_4$ each independently represents a hydrogen atom, an alkyl or alkenyl group having a number of carbons within a range of 1–22, a non-substituted or substituted aromatic group having a number of carbons within a range of 1–20 or an aralkyl group having a number of carbons within a range of 7–20, and $A^-$ represents a molybdic anion or tungstic anion, or a heteropolyacid anion containing a molybdenum or tungsten atom)

General Formula (III)

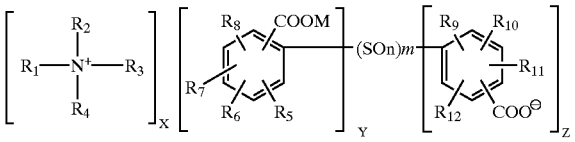

[In the formula, m represents 1, 2 or 3, n represents 0, 1 or 2, M represents a hydrogen atom or a monovalent metal ion, X and Z represent 1 or 2, and Y represents 0 or 1. Y is 1 and Z is 1 when X is 1, and Y is 0 and Z is 2 when X is 2, $R_5$–$R_{12}$ represents hydrogen, a straight or branched chain, a saturated or unsaturated alkyl group having a number of carbons within a range of 1–30, an alkoxylene group having a number of carbons within a range of 1 to 4 or a polyalkyloxylene group represented by the general formula (—$C_{2-5}$ alkylene-O)n—R (provided that R is hydrogen or an alkyl or acyl group having a number of carbons within a range of 1–4, and n is an integer within a range of 1–10), $R_1$, $R_2$, $R_3$ and $R_4$ represent hydrogen, a straight or branched chain, a saturated or unsaturated alkyl group having a number of carbons within a range of 1–30, an oxyethyl group represented by the general formula (—$CH_2$—$CH_2$—O)n—R (provided that R is hydrogen or an alkyl or acyl group having a number of carbons within a range of 1–4, and n is an integer within a range of 1–10), or a mononuclear or polynuclear alicyclic residue, mononuclear or polynuclear aromatic residue or mononuclear or polynuclear aliphatic residue having a number of carbons within a range of 5–12]

More concretely, the quaternary ammonium salt compound includes the following compounds.

Compound (I-1)

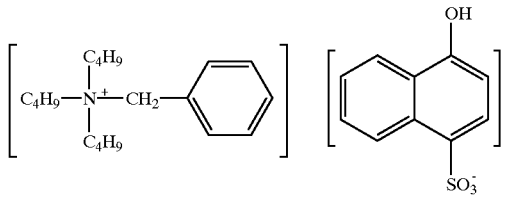

-continued

Compound (II-1)

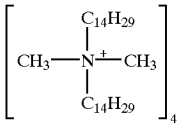

$(Mo_8O_{26})^{4-}$

Compound (II-2)

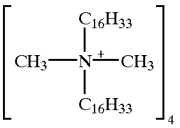

$(Mo_8O_{26})^{4-}$

Compound (II-3)

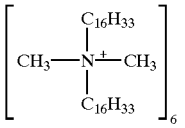

$(Mo_7O_{24})^{6-}$

Compound (II-4)

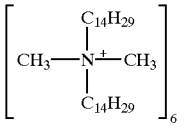

$(Mo_7O_{24})^{6-}$

Compound (II-5)

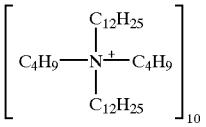

$(H_2W_{12}O_{42})^{10-}$

Compound (II-6)

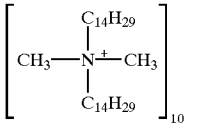

$(H_2W_{12}O_{42})^{10-}$

Compound (II-7)

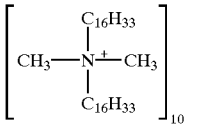

$(H_2W_{12}O_{42})^{10-}$

Compound (II-8)

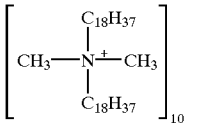

$(H_2W_{12}O_{42})^{10-}$

Compound (II-9)

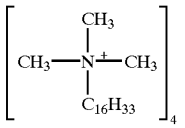

$(Mo_8O_{26})^{4-}$

Compound (II-10)

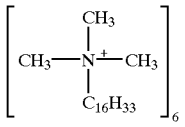

$(Mo_7O_{24})^{6-}$

Compound (II-11)

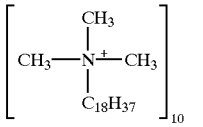

$(H_2W_{12}O_{42})^{10-}$

-continued

Compound (III-1)

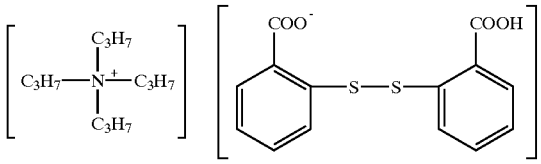

Compound (III-2)

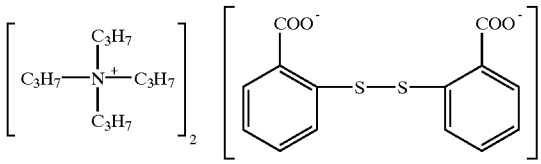

In the present invention, the nigrosine dye is preferably employed in combination with the quaternary ammonium salt compound.

The weight ratio of the nigrosine dye to the quaternary ammonium salt compound is not specifically limited but is preferably within a range of 1/9–9/1, and more preferably within a range of 2/8–8/2. The nigrosine has a high capacity to apply a positive charge, but is liable to cause poor uniformity and poor stability of charging. When using it alone, fogging is liable to occur, resulting in a printed image with poor sharpness. The quaternary ammonium salt compound has a low capacity to apply a positive charge, and some device is required when using alone. By employing the quaternary ammonium salt compound in combination with the nigrosine dye, uniformity and stability of charging are obtained as a result of its synergistic effect and scattering of the toner is advantageously inhibited, thus easily and stably obtaining a clear printed image, which does not exhibit fogging during continuous printing.

When the weight ratio of the nigrosine dye is 1 or less, it becomes difficult to sufficiently charge the toner and to perform normal development, whereby the efficiency of transfer to the paper is liable to be lowered, thus obtaining a low quality image with variable adhesion of the toner at the solid portion and a blurred printing image in the peripheral portion. As a result of the influence of low charging, there is obtained a developer with a short shelf life, which causes severe scattering of the toner. When the weight ratio is larger than 9, since the charge amount is too high, there is obtained a developer which often causes fogging during continuous printing and exhibits unstable charging behavior such as low density/low image quality.

As described above, when the weight ratio is selected within the range described above, the desired charge amount is easily obtained, resulting in a developer which is capable of printing an image with high density/high image quality and causes less scattering of the toner. By appropriately adjusting the ratio between both components, there can be obtained a developer with long shelf life, which attains the optimum charge amount and causes no fogging, and which is capable printing an image with a clear image in the peripheral portion, high density and high quality and also causes no scattering of the toner.

The colored resin particles in the present invention function as a toner and are composed of a binder resin made of the polyester rein described above and a colorant, but may contain other additives.

For example, metallic soaps, zinc stearate, or the like may be employed as the lubricant, and cerium oxide, silicon carbide, or the like may be employed as an abrasive.

The toner of the present invention may be obtained by extremely common manufacturing methods, and does not require special manufacturing methods; however, it is possible to obtain this toner by uniformly mixing the resin, the colorant, the releasing agent and the charge control agent in a non-molten state employing a Henschel mixer, and melt-kneading the mixture at a temperature above the melting point of the resin (the softening point).

When using the above, which are not particularly dispersed in the resin, among various positive control agents and various carbon blacks used in the preparation of the toner of the present invention, for example, the charge control agent and/or the carbon black are preliminary mixed in two stages, that is, they are mixed previously in a non-molten state and then the mixture is further mixed with a releasing agent in a non-molten state, followed by melt-kneading. It is most suitable for melt-kneading of the mixture to take place after multi-stage preliminary mixing.

The toner of the present invention is obtained by pulverizing and classifying the above mixture.

Concretely, the dry mixture containing, as an essential component, the resin, the colorant, the releasing agent and the charge control agent obtained by optional multi-stage preliminary mixing is kneaded by means of a kneading process employing two rollers, three rollers, a pressure kneader, or a twin-screw extruder or the like. At this time, it is sufficient if the colorant and the like are uniformly dispersed in the resin, so that the melting and kneading conditions are not particularly restricted; however, these are commonly within a range of 80–180° C. and from 30 seconds to 2 hours. A flushing procedure may be carried out in advance so that the colorant is uniformly dispersed in the resin, or alternatively, this may be mixed and kneaded at high concentrations with the resin in a master batch.

Next, the resultant is pulverized in a mechanical pulverizer such as a turbo mill, a Kryptron, or the like; or an air type pulverizer such as a volute type jet mill, a counter jet mill, a collision plate type jet mill, or the like, and separated by means of an air classifier or the like.

The average particle diameter of the particles which form the base material of the toner is not particularly restricted; however, this is normally set within a range of 5–15 micrometers.

It is possible to make the toner to meet the above expression (1) only in relation to the colored resin particles (toner ground material), however, the toner employing the colored resin particles in combination with the external additives easily meets the expression (1).

Commonly, the toner ground material thus obtained is mixed with external additives employing a mixing machine such as, for example, a Henschel mixer.

External additives can be employed to improve the surface properties of the toner base material, such as, for example, an increase in the fluidity of the toner, and an improvement in the charge characteristics thereof, or the like. Possible materials employed include, for example, inorganic microparticles such as silicon dioxide (silica), titanium oxide, alumina, and the like, as well as the products resulting when these are subjected to surface treatment employing a hydrophobic treating agent such as silicon oil, or the like. Among these external additives, silica is preferred because it easily makes the toner meet the above expression.

Among these, silicon dioxide having hydrophobicity (silica), the surface of which has been subjected to hydrophobic treatment by means of various polyorganosiloxanes or silane coupling agents, is particularly advantageously employed. Such a product is commercially available under, for example, the following trade names.

AEROSIL; R972, R974, R202, R805, R812, RX200, RA200HS, RY200, R809, RX50 (Nippon Aerosil)

WACKER; HDK K2000, H2050EP, HDK H3050EP, HVK2150 (Wacker Chemicals East Asia)

NIPSIL; SS-10, SS-15, SS-20, SS-50, SS-60, SS-100, SS-50B, SS-50F, SS-10F, SS-40, SS-70, SS-72F (Nippon Silica Industries)

Two or more kinds of silica having different average particle diameters may be employed in combination. The amount of silica is usually within a range of 0.05–5% by weight, and preferably within a range of 0.1–3% by weight, based on the toner ground material.

The developer for electrostatic image development of the present invention comprises the toner containing the colored resin particles of the present invention and a magnetic carrier, preferably a magnetic carrier whose surface is coated with a resin.

The core agent of the carrier (magnetic carrier) employed in the present invention may be the iron powder carrier which is commonly employed in the two-component development method, a magnetite carrier, or a ferrite carrier; among these, ferrite or magnetite carriers, which have a low true specific gravity, a high resistance, which have superior environmental stability, and are easy to make spherical and thus have good flow characteristics, are preferably employed. The shape of the core agent may be spherical or unspecified. The average particle diameter is generally within a range of 10–500 $\mu$m; however, in printing high-resolution images, a range of 30–100 $\mu$m is preferable.

Furthermore, a coated carrier in which such a carrier is covered with resin may be employed, and examples of the coating resin include, for example, polyethylene, polypropylene, polystyrene, polyacrylonitrile, polyvinyl acetate, polyvinyl alcohol, polyvinyl butyral, polyvinyl chloride, polyvinyl carbazole, polyvinyl ether polyvinylketone, vinyl chloride-vinyl acetate copolymer, styrene/acrylic copolymer, straight silicone resin comprising organosiloxane bonds or derivatives thereof, fluorine resin, (meth) acrylate resin, polyester, polyurethane, polycarbonate, phenol resin, amino resin, melamine resin, benzoguanamine resin, urea resin, amide resin, epoxy resin and the like.

Among these, silicone resin, fluorine resin, and (meth) acrylate resin have superior charge stability and coating strength and are preferably employed. In other words, in the present invention, it is preferable that the magnetic carrier be a resin coated magnetic carrier which contains ferrite or magnetite as a core agent and is coated with one or more resins selected from a group consisting of silicone resin, fluorine resin, and (meth) acrylate resin.

The method of coating the surface of a carrier core material with a resin is not specifically limited but includes, for example, a dipping method of dipping in a solution of a coating resin, a spraying method of spraying a coating resin solution over the surface of a carrier core material, a fluidized bed method of spraying a carrier by an air flow in a suspended state, a kneader coater method of mixing a carrier core material with a coating resin solution in a kneader coater and removing a solvent, or the like.

The solvent employed in the coating resin solution is not specifically limited provided it dissolves the coating resin and, for example, there can be employed toluene, xylene, acetone, methyl ethyl ketone, tetrahydrofuran, dioxane, or the like. The thickness of the coating layer on the carrier surface is usually within a range of 0.1–3.0 $\mu$m.

The carrier coated with the resin, which is employed suitably in the present invention, is subjected to heat treatment, if necessary. In the case of coating with the resin containing a crosslinking component, the layer is further improved by a thermocrosslinking reaction which imparts far better durability to the carrier, which is preferred.

When subjected to heat treatment, the charge amount can be controlled when mixed with the toner according to the temperature conditions. The higher the heating temperature, the higher the charge amount. Commonly, the heat treatment is conducted at a temperature within a range of 100–300° C. for 10 minutes to 5 hours.

Since the carriers are sometimes bonded to each other after the completion of the heat treatment, carrier particles are separated by applying stress.

The resin-coated carrier which has been subjected to the heat treatment is preferably employed as the carrier so that the proportion of the toner having a particle diameter in a range of from 12 $\mu$m to 16 $\mu$m, inclusive, in the developer and the specific charge amount of the toner meet the above expression (1), the developer being made by employing the toner and carrier in combination which combination is employed preferably in the present invention.

The weight ratio of the toner containing the colored resin particles to the resin-coated magnetic carrier is not specifically limited, but the amount of the toner is usually within a range of 0.5–10 parts by weight based on 100 parts by weight of the carrier.

EXAMPLES

The following Examples and Comparative Examples further illustrate the present invention in detail. Hereinbelow, the numerical values within the composition descriptions indicate parts by weight. First, an example of the synthesis of the binder resin which is employed in the preparation of the toner will be given.

With respect to the particle size distribution, A in the expression (1) was determined by employing a multisizer (produced by Coulter Co.). With respect to the charge amount of the toner, B in the expression (1) was determined by employing an E-SPART ANALYZER (produced by Hosokawa Micron Co.). The details of the conditions are as follows.

Measuring Conditions

1) Conditions for preparation of developer:

Mixing ratio: toner/carrier=3/97 (weight ratio)

Mixing container: 5 cm in diameter and 6 cm in height, made of polypropylene

Mixing conditions: stroke of 3 cm, 790 rotary oscillations per minute, mixing time of 3 minutes 2) Measuring conditions:

E-SPART ANALYZER

Toner blow pressure: 0.05 MPa

Number of counted particles: 1000

Difference in potential between electrodes: 100 V

Employing the E-SPART ANALYZER, a specific charge amount was measured for each particle diameter of the toner. The particle size distribution measured by the multisizer nearly corresponds with that measured by the E-SPART ANALYZER.

Synthesis of straight-chain polyester A

Terephthalic acid: 332 parts by weight

Isophthalic acid: 332 parts by weight

Polyoxypropylene-(2.2)-2,2-bis(4-hydroxyphenyl) propane: 1500 parts by weight

The above materials were charged in a four-necked flask equipped with a stirrer, a condenser and a thermometer and 4 parts by weight of tetrabutyl titanate was added in a nitrogen gas flow, and then the mixture was reacted at 240° C. under normal pressure for 15 hours while removing water produced by the dehydration condensation. Subsequently, depressurization was conducted and the reaction was continued under a pressure of 5 mmHg. After this stage of the reaction the softening point was reached in accordance with the ASTM E28-517, and the reaction was completed when the softening point reached 95° C. The resulting linear polyester had a Mw of 9500, Mw/Mn of 3.1, a softening point of 96° C., an acid number of 4, and a Tg (determined by the DSC measuring method) of 63° C.

Synthesis of crosslinked polyester B

Terephthalic acid: 332 parts by weight

Isophthalic acid: 332 parts by weight

Polyoxypropylene-(2.2)-2,2-bis(4-hydroxyphenyl) propane: 700 parts by weight

Trimethylolpropane: 80 parts by weight

Ethylene glycol: 130 parts by weight

The above materials were charged in a four-necked flask equipped with a stirrer, a condenser and a thermometer and 4 parts by weight of tetrabutyl titanate was added in a nitrogen gas flow, and then the mixture was reacted at 240° C. under normal pressure for 10 hours while removing water produced by the dehydration condensation. Subsequently, depressurization was conducted and the reaction was continued under a pressure of 5 mmHg. After this stage of the reaction the softening point was reached in accordance with the ASTM E28-517, and the reaction was completed when the softening point reached 151° C. The resulting crosslinked polyester had a THF-insoluble content of 5%, a molecular weight Mw (of THF-soluble fraction) of 180000, Mw/Mn of 48, a softening point of 153° C., an acid number of 4, and a Tg (determined by the DSC measuring method) of 65° C. The THF-insoluble content was determined by placing 1 g of the synthesized resin powder on a particular filter paper and heating at reflux in THF as a solvent for eight hours employing a Soxhlet's reflux condenser.

EXAMPLE 1

Preparation of the Toner

Straight-chain polyester A: 33 parts by weight

Crosslinked polyester B: 67 parts by weight

Carbon black

Black Pearls L (produced by Cabot Specialty Chemicals Incorporated): 5 parts by weight Charge control agent (positive charge control agent)

Nigrosine dye

Bontron N-07 (produced by Orient Chemical Industries Incorporated): 2 parts by weight Quaternary ammonium salt compound Bontron P-51 (produced by Orient Chemical Industries Incorporated): 1 part per weight Wax Purified carnauba wax No. 1 (acid number: 5; produced by CERA RICA NODA Limited): 2 parts by weight The above materials were mixed in a Henschel mixer, and were kneaded in a twin-screw kneader. The kneaded mixture obtained in this manner was pulverized and classified to produce a toner raw material A' wherein the volume % of particles having a particle diameter in a range of from 12 μm to 16 μm, inclusive is 13.0%.

100 Parts by weight of the resulting toner raw material A' and 1 part of silica HDK3050EP (produced by Wacker Chemicals) were mixed in a Henschel mixer and sifted to produce a toner A". In the same manner described above, toners B" (Example 2), C" (Examples 3 and 4, and Comparative Example 2), D" (Example 5) and E" (Comparative Example 1) were produced.

Preparation of Developer

3 Parts by weight of the above toner A" and 97 parts by weight of a carrier J (silicone resin-coated ferrite carrier) were mixed with stirring to produce developer A.

A carrier J is a carrier produced by coating ferrite particles with a silicone resin and crosslinking the coating resin with heating at 250° C. for 10 minutes.

In the same manner as described above, by using the toners B", C", D" and E", a developer B (Example 2), a developer C (Example 3), a developer E (Example 5) and a developer F (Comparative Example 1) were produced according to the formulations shown in Table 1 in the same manner as in the developer A (Example 1).

A developer D (Example 4) was produced in the same manner as in Example 3, except that a toner was produced according to the formulation described in Table 1 in the same manner as in Example 1 and a carrier K (fluorinated acrylic resin-coated magnetite carrier) was employed.

A carrier K is a carrier produced by coating ferrite particles with a fluorinated acrylic resin and crosslinking the coating resin through heating at 250° C. for 10 minutes.

Preparation of Developer D

Above toner C": 3 parts by weight

Carrier K (fluorinated acrylic resin-coated magnetite carrier): 97 parts by weight A developer G (Comparative Example 2) was produced in the same manner as in Example 3, except that the same toner as in Example 3 was employed and a carrier L (silicone resin-coated ferrite carrier) was employed.

The carrier L is a carrier treated under the condition where the temperature of the heat treatment is 50° C. lower than that in the case of the carrier J.

Preparation of Developer G

Above toner C": 3 parts by weight

Carrier L (silicone resin coated ferrite carrier): 97 parts by weight

The proportion (A) of particles having a particle diameter within a range of 12–16 μm was determined from the numerical value of the volume % by measuring the particle size distribution employing a multisizer.

TABLE 1

| | Formulation | | | | | | | | | | |
|---|---|---|---|---|---|---|---|---|---|---|---|
| | Developer | Straight-chain resin | Crosslinked resin | Carbon black | Nigrosine | Quaternary ammonium salt | Wax | Toner raw material particles of 12–16 μm (volume %) | Silica | Toner | Carrier |
| Example 1 | A | Polyester A 33 Parts | Polyester B 67 Parts | Black Pearls L 5 parts | N-07 2 Parts | P-51 1 Part | Carnauba* 2 parts | 13.0 | HDK3050EP** | A" | J |
| Example 2 | B | Polyester A 33 Parts | Polyester B 67 Parts | Black Pearls L 5 parts | N-07 2 Parts | None 2 parts | Carnauba* | 20.0 | HDK3050EP** | B" | J |
| Example 3 | C | Polyester A 33 Parts | Polyester B 67 Parts | Black Pearls L 5 parts | N-07 2 Parts | TP-302 1 Part | Carnauba* 2 parts | 15.7 | HDK3050EP** | C" | J |
| Example 4 | D | Polyester A 33 Parts | Polyester B 67 Parts | Black Pearls L 5 parts | N-07 2 Parts | TP-302 1 Part | Carnauba* 2 parts | 15.7 | HDK3050EP** | C" | K |
| Example 5 | E | Polyester A 33 Parts | Polyester B 67 Parts | Black Pearls L 5 parts | N-07 2 Parts | Compound III-1 1 Part | Carnauba* 2 parts | 21.3 | HDK3050EP** | D" | J |
| Comp. Example 1 | F | Polyester A 33 Parts | Polyester B 67 Parts | Black Pearls L 5 parts | N-07 2 Parts | P-51 1 Part | Carnauba* 2 parts | 54.1 | HDK3050EP** | E" | J |
| Comp. Example 2 | G | Polyester A 33 Parts | Polyester B 67 Parts | Black Pearls L 5 parts | N-07 2 Parts | TP-302 1 Part | Carnauba* 2 parts | 15.7 | HDK3050EP** | C" | L |

TP-302: produced by Hodogaya Chemical Industries Co., Ltd.

*Carnauba: Purified carnauba wax No. 1 (acid number: 5; produced by CERA RICA NODA Limited)

**1 part by weight of Silica HDK3050EP was mixed with 100 parts by weight of toner raw material to produce a toner.

With respect to the developers obtained in the Examples and Comparative Examples described above, the charge amount distribution of the toner was measured by employing the E-SPART ANALYZER and Q/M (B) of the toner having a particle diameter within a range of 12–16 μm in each developer was determined from each particle diameter and the measured value of the charge amount for each particle diameter. The results are summarized in Table 2.

TABLE 2

| | Developer | Volume average particle diameter (μm) | Proportion of particles of 12–16 μm in size (% by volume) A | Left side of expression (1) | Q/M of particles of 12–16 μm in size (Mc/g) B |
|---|---|---|---|---|---|
| Example 1 | A | 10.0 | 13.0 | 6.7 | 8.5 |
| Example 2 | B | 10.0 | 20.0 | 7.6 | 9.7 |
| Example 3 | C | 9.8 | 15.7 | 7.1 | 9.7 |
| Example 4 | D | 9.8 | 15.7 | 7.1 | 11.7 |
| Example 5 | E | 10.2 | 21.3 | 7.7 | 8.6 |
| Comp. Example 1 | F | 13.2 | 54.1 | 11.6 | 9.2 |
| Comp. Example 2 | G | 9.8 | 15.7 | 7.1 | 6.9 |

As is apparent from Table 2, Examples 1–5 meet the expression (1), whereas, Comparative Examples 1 and 2 do not meet the expression.

Employing the developers described above, continuous printing (300 m) on a continuous paper was conducted by a printer for positive charge toner (4.5 m/min.) and the state of scattering of the toner in the developer was visually observed after 100 m printing and 300 m printing. The results are shown in Table 3.

TABLE 3

| | Developer | State of scattering of toner 100 m | 300 m |
|---|---|---|---|
| Example 1 | A | ○ | ○ |
| Example 2 | B | ○ | Δ |
| Example 3 | C | ○ | Δ |
| Example 4 | D | ○ | ○ |
| Example 5 | E | ○ | Δ |
| Comp. Example 1 | F | x | xx |
| Comp. Example 2 | G | x | x |

o: Any scattering of the toner is observed.

Δ: Contamination with toner is observed when wiping off the inside of the device with waste cloth, though scattering is hardly observed.

x: Scattering in the device can be confirmed.

xx: Severe scattering in the device can be confirmed.

As is apparent from the results, less scattering of the toner occurred in Examples 1–5, whereas, severe scattering of the toner occurred and the inside of the developing device was contaminated in Comparative Examples 1 and 2.

What is claimed is:

1. A developer for electrostatic image development comprising colored resin particles comprising at least a binder resin and a colorant, and a magnetic carrier, said binder resin being a polyester resin, wherein a proportion of said colored resin particles having a particle diameter in a range of from 12 μm to 16 μm, inclusive, in said developer and a specific charge amount of said colored resin particles meet the following expression (1):

$$5.18+0.12\times A<B \quad (1)$$

(where A represents a proportion (% by volume) of colored resin particles having a particle diameter in a range of from 12 μm to 16 μm, inclusive, and B represents a specific charge amount Q/M (μC/g) of colored resin particles having a particle diameter in a range of from 12 μm to 16 μm, inclusive).

2. A developer for electrostatic image development in accordance with claim 1, wherein said colored particles further contain a releasing agent.

3. A developer for electrostatic image development in accordance with claim 1, wherein said colored resin particles further contain a charge control agent.

4. A developer for electrostatic image development in accordance with claim 1, wherein said magnetic carrier is resin-coated magnetic carrier coated with one or more resins selected from the group consisting of silicone resin, fluororesin, and (meth)acrylic resin.

5. A developer for electrostatic image development comprising colored resin particles comprising at least a binder resin and a colorant, and a magnetic carrier, said binder resin being a resin of a straight-chain polyester resin (i) employed in combination with a crosslinked polyester resin (ii), wherein a proportion of said colored resin particles having a particle diameter in a range of from 12 μm to 16 μm, inclusive, in said developer and a specific charge amount of said colored resin particles meet the following expression (1):

$$5.18+0.12\times A<B \quad (1)$$

(where A represents a proportion (% by volume) of colored resin particles having a particle diameter in a range of from 12 μm to 16 μm, inclusive, and B represents a specific charge amount Q/M (μC/g) of colored resin particles having a particle diameter in a range of from 12 μm to 16 μm, inclusive).

6. A developer for electrostatic image development in accordance with claim 5, wherein a mixing ratio (weight ratio) of said straight-chain polyester resin (i) to said crosslinked polyester resin (ii), (i)/(ii), is within a range of 2/8–8/2.

7. A developer for electrostatic image development in accordance with claim 5, wherein the softening point of said straight-chain polyester resin (i) is within a range of 80–120° C. and the weight-average molecular weight (Mw) is within a range of 7000–12000 and, moreover, a ratio of the weight-average molecular weight to the number-average molecular weight (Mn), (Mw/Mn), is 4 or less.

8. A developer for electrostatic image development in accordance with claim 5, wherein the softening point of said crosslinked polyester resin (ii) is within a range of 130–180° C. and the weight-average molecular weight (Mw) of a component which dissolves in tetrahydrofuran is within a range of 100000–400000 and, moreover, a ratio of the weight-average molecular weight to the number-average molecular weight (Mn), (Mw/Mn), is 10 or more.

9. A developer for electrostatic image development in accordance with claim 5, wherein said colored resin particles further contain a releasing agent.

10. A developer for electrostatic image development in accordance with claim 5, wherein said colored resin particles further contain a charge control agent.

11. A developer for electrostatic image development in accordance with claim 10, wherein said charge control agent contains a nigrosine dye and/or a quaternary ammonium salt compound.

12. A developer for electrostatic image development in accordance with claim 10, wherein said charge control agent contains a quaternary ammonium salt compound which is at least one selected from the group consisting of the compounds represented by the following formulas (I), (II) and (III):

General formula (I)

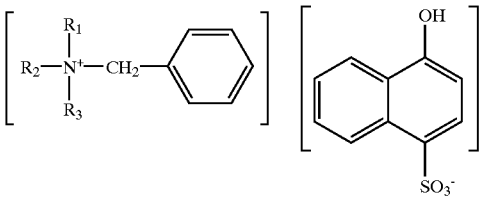

(In the formula, $R_1$–$R_3$ represents a group of $C_nH_{2n+1}$, provided that n represents an integer within a range of 1–10 and $R_1$–$R_3$ may be the same or different)

General Formula (II)

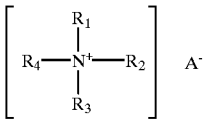

(In the formula, $R_1$, $R_2$, $R_3$ and $R_4$ each independently represents a hydrogen atom, an alkyl or alkenyl group having a number of carbons within a range of 1–22, a non-substituted or substituted aromatic group having a number of carbons within a range of 1–20 or an aralkyl group having a number of carbons within a range of 7–20, and $A^-$ represents a molybdic anion or tungstic anion, or a heteropolyacid anion containing a molybdenum or tungsten atom)

General Formula (III)

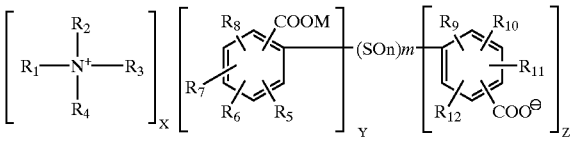

(In the formula, m represents 1, 2 or 3, n represents 0, 1 or 2, M represents a hydrogen atom or a monovalent metal ion, X and Z represent 1 or 2, and Y represents 0 or 1, Y is 1 and Z is 1 when X is 1, and Y is 0 and Z is 2 when X is 2, $R_5$–$R_{12}$ represents hydrogen, a straight or branched chain, a saturated or unsaturated alkyl group having a number of carbons within a range of 1–30, an alkoxylene group having a number of carbons within a range of 1 to 4 or a polyalkyloxylene group represented by the general formula $(—C_{2-5}$ alkylene-O$)_n$—R (provided that R is hydrogen or an alkyl or acyl group having a number of carbons within a range of 1–4, and n is an integer within a range of 1–10), $R_1$, $R_2$, $R_3$ and $R_4$ represent hydrogen, a straight or branched chain, a saturated or unsaturated alkyl group having a number of carbons within a range of 1–30, an oxyethyl group represented by the general formula $(—CH_2—CH_2—0)_n$—R (provided that R is hydrogen or an alkyl or acyl group having a number of carbons within a range of 1–4, and n is an integer within a range of 1–10), or a mononuclear aromatic residue or mononuclear or polynuclear aliphatic residue having a number of carbons within a range of 5–12).

13. A developer for electrostatic image development in accordance with claim 5, wherein said magnetic carrier is a resin-coated magnetic carrier coated with one or more resins selected from the group consisting silicone resin, fluororesin, and (meth)acrylic resin.

* * * * *